US012653223B2

(12) United States Patent
Erbi'

(10) Patent No.: US 12,653,223 B2
(45) Date of Patent: Jun. 16, 2026

(54) APPARATUS AND METHOD FOR ALIGNING ROD-SHAPED AEROSOL-GENERATING ARTICLES

(71) Applicant: Philip Morris Products S.A., Neuchatel (CH)

(72) Inventor: Efisio Erbi', Cagliari (IT)

(73) Assignee: Philip Morris Products S.A., Neuchatel (CH)

( * ) Notice: Subject to any disclaimer, the term of this patent is extended or adjusted under 35 U.S.C. 154(b) by 438 days.

(21) Appl. No.: 18/551,929

(22) PCT Filed: Mar. 28, 2022

(86) PCT No.: PCT/EP2022/058076

§ 371 (c)(1),
(2) Date: Sep. 22, 2023

(87) PCT Pub. No.: WO2022/207540

PCT Pub. Date: Oct. 6, 2022

(65) Prior Publication Data

US 2024/0164437 A1 May 23, 2024

(30) Foreign Application Priority Data

Mar. 29, 2021 (EP) ..... 21165558

(51) Int. Cl.
*A24C 5/01* (2020.01)
*A24C 5/32* (2006.01)
(Continued)

(52) U.S. Cl.
CPC ..... *A24C 5/01* (2020.01); *A24C 5/327* (2013.01); *A24C 5/3412* (2013.01); *A24C 5/345* (2013.01); *A24C 5/325* (2013.01)

(58) Field of Classification Search
None
See application file for complete search history.

(56) References Cited

U.S. PATENT DOCUMENTS 4,149,546 A 4/1979 Luke et al.
4,883,449 A 11/1989 Heaney et al.
(Continued)

FOREIGN PATENT DOCUMENTS

DE 10 2014 215 232 B3 7/2015
EP 3 461 352 A1 4/2019
(Continued)

OTHER PUBLICATIONS

EP 3,461,352 English Machine Translation (Year: 2019).*
(Continued)

*Primary Examiner* — Michael H. Wilson
*Assistant Examiner* — Daniel Edward Vakili
(74) *Attorney, Agent, or Firm* — Oblon, McClelland, Maier & Neustadt, L.L.P.

(57) ABSTRACT

An apparatus for aligning rod-shaped aerosol-generating articles including a susceptor band, the apparatus including: a conveyor configured to accommodate and transport an aerosol-generating article including a susceptor band; a holder configured to hold the aerosol-generating article in the conveyor and to allow temporary rotation of the aerosol-generating article; a magnetic positioner configured to rotate the aerosol-generating article held by the holder around a longitudinal axis of the aerosol-generating article to a defined position; and a cutting device configured to cut the aerosol-generating article in the defined position, the magnetic positioner including at least one rotatable magnetic shaft. A method for aligning rod-shaped aerosol-generating articles including the susceptor band is also provided.

15 Claims, 3 Drawing Sheets

(51) Int. Cl.
*A24C 5/34* (2006.01)
*A24C 5/345* (2006.01)

(56) References Cited

U.S. PATENT DOCUMENTS

| | | | |
|---|---|---|---|
| 4,969,551 | A | 11/1990 | Heitmann et al. |
| 5,468,299 | A | 11/1995 | Tsai |
| 6,647,844 | B1 | 11/2003 | Nowaczyk |
| 2021/0084981 | A1 | 3/2021 | Rogan et al. |

FOREIGN PATENT DOCUMENTS

| | | | |
|---|---|---|---|
| GB | 784579 | | 10/1957 |
| GB | 2 267 474 | A | 12/1993 |
| JP | 2008-30874 | A | 2/2008 |
| RU | 2 651 445 | C2 | 4/2018 |
| RU | 2 710 465 | C2 | 12/2019 |
| WO | WO 2020/109203 | A1 | 6/2020 |

OTHER PUBLICATIONS

International Search Report and Written Opinion issued Sep. 16, 2022 in PCT/EP2022/058076 filed on Mar. 28, 2022, 11 pages.
Combined Russian Office Action and Search Report issued Aug. 27, 2025 in Russian Patent Application No. 2023127618, 12 pages.
Chinese Notification of Grant issued on Nov. 13, 2025 in Chinese Patent Application No. 202280023565.4, 5 pages.

* cited by examiner

APPARATUS AND METHOD FOR ALIGNING ROD-SHAPED AEROSOL-GENERATING ARTICLES

The present disclosure relates to an apparatus and method for aligning rod-shaped aerosol-generating articles comprising a susceptor band.

In electronic heated-not-burn devices using induction heating, the rod-shaped consumables comprise a susceptor band that is inductively heated by alternating magnetic fields for heating aerosol-forming substrate in proximity of the susceptor band. Upon manufacturing the consumables, a continuous susceptor band is inserted into aerosol-forming substrate. A continuous rod is formed and then cut into individual segments, which segments are combined with other segments to form the consumable to be used with the induction heating device.

In the rod, the susceptor band should be allocated in the center. The susceptor band should not be damaged or deformed by the cutting process. Both location and integrity of the susceptor may alter the heating efficiency, a temperature distribution or may lead to inconsistency of the performance of the consumable.

For cutting the rods, the rods may be placed in flutes of a conveyor drum and cut by a circular knife. However, because the rods typically come to the conveyor drum from a mass flow, for example a hopper, the position of a rod on the conveyor drum is random, so that the rotational position of the susceptor band inside the rod in relation to the axis of the conveyor drum is random. Consequently, the cutting angle under which the susceptor band is cut by the circular knife is random.

From the European patent publication EP 3461352 it is known to rotate articles of the tobacco processing industries such that the magnetic bands in the articles all have a same vertical or horizontal position with respect to their flutes. The magnetic bands are rotated by means of a magnetizing device interacting with the magnetic band in the articles.

It would be desirable to provide an apparatus and method for aligning rod-shaped articles by magnetic means, wherein a rotational position of the susceptor band in the article is defined for all articles and optimized for cutting the articles. In particular, it would be desirable to have such an apparatus and method having a simple set-up.

According to the invention there is provided an apparatus for aligning rod-shaped aerosol-generating articles comprising a susceptor band. The apparatus comprises a conveyor for accommodating and transporting an aerosol-generating article comprising a susceptor band and a holding means for holding the aerosol-generating article in the conveyor, wherein the holding means is adapted to allow temporary rotation of the aerosol-generating article. The apparatus further comprises a magnetic positioning unit for rotating the aerosol-generating article held by the holding means around a longitudinal axis of the article to a defined position and a cutting device for cutting the aerosol-generating article in the defined position, wherein the magnetic positioning unit comprises at least one rotatable magnetic shaft.

The aerosol-generating article is transported with the conveyor. Preferably, the conveyor comprises the holding means. The holding means may be integrated in the conveyor. The article is held by the holding means while being conveyed in the conveyor, for example from a receiving location to a downstream arranged magnetic positioning unit.

In articles comprising a susceptor band to be cut or to be processed otherwise, for example for assembly with other segments, wherein a specific mutual relative position of the susceptor band with another segments is desired or mandatory, the position of the susceptor band should be defined and consistent for all articles. For example, it has been found that a random orientation of the susceptor band in the article may lead to irregular cutting, deformation of the susceptor or even a reduced lifetime of a cutting knife. Thus, it may be beneficial that the magnetic positioning unit interacts with the susceptor band in the aerosol-generating article to achieve an optimized rotational positioning of the article before cutting the article. By the magnetic force of the magnetic positioning unit acting on the susceptor band, the article is rotated around its longitudinal axis until the rotational position of the susceptor band in the article corresponds to a defined position. The use of a magnetic positioning unit is advantageous as the magnetic positioning unit interacts with the susceptor band irrespective of the original rotational position of the susceptor band. The applied magnetic force causes the susceptor band to rotate and align with the magnetic field lines. The magnetic positioning unit comprising a rotatable magnetic shaft is arranged such that the defined position of the article corresponds to an optimized cutting angle of the susceptor band with respect to the cutting device.

In short, the magnetic force of the magnetic positioning device is coupled to the susceptor band in the article. If required, the magnetic shaft is rotated in order to rotate the susceptor band and the article with the susceptor band. The invention uses the inhomogeneity of the magnetic field to rotate the susceptor band into the desired position, based on the original position of the susceptor band relative to the magnetic field lines of the magnetic shaft. By this adjustable rotational orientation of a magnetic shaft any alignment of susceptor band relative to a cutting device may be realized.

It has been found that the relative position of a susceptor band with respect to a cutting knife has a large impact on the quality of the cut. It is generally acknowledged that for a clear cut of a rod-shaped article, a plane of a cutting knife and a longitudinal axis of a rod-shaped article should be perpendicular to each other. It has also been found that an optimized cutting angle between the susceptor band and the cutting blade improves not only the quality of the cut but also the lifetime of the cutting knife.

Preferably, in the defined position of the aerosol-generating article a cutting angle under which the susceptor band in the article is cut by the cutting device is smaller than 90 degrees and preferably between 20 degrees and 70 degrees. More preferably, the cutting angle is between 30 degrees and 60 degrees, for example 45 degrees plus or minus 5 degrees.

The cutting angle is defined between the plane of the susceptor band and a position of a cutting edge of the cutting device at the moment when the cutting device starts to cut the susceptor band. In the case where the cutting device is a linear knife, the cutting angle is defined between the plane of the susceptor band and the straight cutting edge of the linear knife. In the case where the cutting device is a rotary cutting knife, the cutting angle is defined between the plane of the susceptor band and a tangent of a cutting edge of a rotary cutting knife at the moment when the cutting edge starts to cut the susceptor band.

Preferably, the at least one rotatable magnetic shaft is diametrically magnetized. Thus, the magnetic poles extend along a length of the magnetic shaft. Preferably, the magnetic poles extend each over a half of the magnetic shaft.

Preferably, the at least one rotatable magnetic shaft has the form of a rod. A longitudinal and symmetric form of a magnetic shaft is advantageous for consistently acting over a length, preferably an entire length, of a rod-shaped article. The rotatable magnetic shaft in the form of a rod may comprise at least one slit. The slit is running circumferentially around a longitudinal rotation axis of the at least one rotatable magnetic shaft for parts of the cutting device to pass through the at least one slit to cut the aerosol-generating article. The slit is intended for a cutting knife to pass through the slit. By this, a cutting device can be positioned close to the article to be cut. A construction of cutting device and magnetic positioning unit may thus be kept very compact. In addition, a positioning of the article may occur immediately before cutting the article, such that the article may be cut before inadvertently being displaced from the defined position.

The magnetic shaft is rotatable to bring the shaft in an optimized rotational position such that the interaction with the susceptor band leads to an optimized rotational position of the article and an optimized cutting angle for the susceptor. The rotatability of the magnetic shaft preferably allows an adjustment of the rotational position of the magnetic shaft during a running aligning process. For example, the rotatability of the magnetic shaft preferably allows a fine tuning during a running process or allows adjustment during a starting of a positioning process, such as during ramping up of the apparatus. Appropriate process controls and actuators for the at least one or preferably several magnetic shafts as will be described in more detail below may be provided.

Preferably, a longitudinal rotation axis of the at least one rotatable magnetic shaft is arranged parallel to a longitudinal axis of the article held on the conveyor. Thus, the rotation axis of the at least one rotatable magnetic shaft is preferably arranged parallel to a longitudinal axis of a seat in the conveyor. The rotatable magnetic shaft may be arranged to extend over a width, preferably an entire width, of the conveyor, so that preferably the rotatable magnetic shaft may accordingly extend over an entire length of an article.

Typically, the rotation axis of the at least one rotatable magnetic shaft is arranged perpendicular to a moving direction of the conveyor, wherein the longitudinal axis of the article is also arranged perpendicular to the moving direction of the conveyor.

Preferably, the apparatus comprises a guiding element arranged at a distance and parallel to the conveyor for preventing aerosol-generating articles from falling off the conveyor. The guiding element may also prevent articles from slipping into a next seat or flute in the conveyor. The guiding element may be part of the holding means. The guiding element is arranged and constructed to allow articles in a conveyor to pass below the guiding element but to keep the articles in the conveyor, for example in a flute of a conveyor drum.

In the apparatus of the present invention, the magnetic positioning unit is arranged external to the conveyor. Preferably, the magnetic positioning unit is arranged entirely external to the conveyor. An external position of the magnetic positioning unit with respect to the conveyor may simplify the construction of a conveyor and the interplay of conveyor and magnetic positioning unit. For example, the positioning unit may be arranged entirely stationary and independent from a form or construction of a conveyor.

In some embodiments of the present invention, the magnetic positioning unit or the at least one rotatable magnetic shaft may be mounted on a guiding element. Preferably, the entire magnetic positioning unit is mounted on the guiding element.

The cutting device may also be mounted on the guiding element. By combining different components of the apparatus, such as mounting the magnetic positioning unit, or the cutting device or both the magnetic positioning unit and the cutting device on the guiding element, a compact and space saving construction of the apparatus may be achieved.

The apparatus comprises a cutting device for cutting the aerosol-generating article. The cutting device is arranged downstream of the magnetic positioning unit. This arrangement may assure that an aerosol-generating article has been positioned to a defined position before being cut by the cutting device. The article may be cut by a knife with a straight cutting edge or a knife with a circular cutting edge. Preferably, the cutting device comprises at least one circular cutting knife. In some embodiments, the cutting device comprises several cutting knives, preferably, several circular cutting knives.

Preferably, the cutting device comprises a series of circular cutting knives. The series of circular cutting knives may be arranged in parallel to each other. The series of circular cutting knives may be arranged in sequence to each other. Series of cutting knives may be arranged in sequence offset to each other as well as in parallel to each other. In typical cutting processes of rod-shaped aerosol-generating articles, a rod is cut once, twice or three times simultaneously in parallel. The cut rod is transported further downstream and cut again, preferably several times, by further cutting knives, preferably, until a cut article has a desired length. The desired length may be a final length of an article to be used as a segment in a consumable. The desired length may be a length longer than a final length, as there may be further cutting steps further downstream in the manufacturing line, for example, after an article with a desired length has been attached to other segments.

Preferably, the apparatus comprises several rotatable magnetic shafts arranged in sequence to each other, wherein a rotatable magnetic shaft is arranged upstream of a circular cutting knife. By having several rotatable magnetic shafts arranged in sequence to each other a rod-shaped aerosol-generating article may be correctly positioned in the defined position before being cut in subsequent cutting steps. For example, an article may be slightly displaced by a cutting step or a susceptor band may have been irregularly positioned in an article along the length of the article to be cut. By a renewed positioning of an article or a cut article, preferably before each subsequent cutting step, an amount of waste that may be caused by a defective cut of the susceptor band in the apparatus may be decreased.

Preferably, each rotatable magnetic shaft of the several rotatable magnetic shafts is assigned to a different circular cutting knife of the series of circular cutting knives.

By such an arrangement of magnetic positioning unit, no visual or other detection system for the detection of the orientation of the susceptor band is required, neither upstream of the cutting nor in between subsequent cutting steps.

Preferably, all of the several rotatable magnetic shafts are diametrically magnetized.

Preferably, all of the several rotatable magnetic shafts have the form of a rod comprising slits, the slits running circumferentially around the longitudinal axes of the several rotatable magnetic shafts. Preferably, the slits are equally distanced from each other.

The magnetic positioning unit may comprise a permanent magnet or an electromagnet. Preferably, the magnetic positioning unit comprises permanent magnets only. Permanent magnets are advantageous as they are independent from a power supply otherwise required for operating an electromagnet.

The conveyor may be a conveyor band or a conveyor drum, preferably comprising several seats for accommodating a rod-shaped aerosol-generating article in a seat.

Conveyors with seats may individually and securely transport an article from a receiving location, where the article is received in the seat of the conveyor and held therein by the holding means, to a further downstream located positioning location and a cutting location.

Preferably, the conveyor is a fluted conveyor drum comprising several flutes, each flute for accommodating an aerosol-generating article. Typically, the aerosol-generating article is a semi-finished product and a component or a multiple of a component of a consumable. Through rotation of the conveyor drum the articles may be conveyed to different locations along the periphery of the conveyor drum in a secure and space saving manner.

Preferably, a rotation axis of the at least one rotatable magnetic shaft is arranged parallel to the flutes of the fluted conveyor drum.

Preferably, a holding means comprises suction means. Preferably, the suction means are applicable to a seat in the conveyor, the seat for accommodating the aerosol-generating article. Preferably, the holding means is designed to allow temporary rotation of the aerosol-generating article. This may be achieved, for example, by reducing a suction force while rotating the article, or by interrupting suction force in a location where the article is rotated.

The apparatus may comprise an output control for detecting a condition of the susceptor band in a cut aerosol-generating article, for comparing the detected condition with quality specifications, for rejecting cut aerosol-generating articles as waste when not meeting the quality specifications, and for triggering the magnetic positioning unit for adjusting the at least one rotatable magnetic shaft, if the rejected cut aerosol-generating article exceed a predefined waste threshold.

By the output control, the final result of the entire cutting process may be controlled and used for adjusting the magnetic positioning unit. This may result in even further improved cut articles and reduced waste.

The condition of the susceptor band in the cut article has to meet predefined quality specifications in order to be accepted and not to be rejected as waste.

The output control may detect, for example, a rotational position of the susceptor band in the cut aerosol-generating article or the absolute position of the susceptor band in the article. For example, the output control may detect a displacement of the susceptor band out of the center of the article and in the direction of the circumference of a rod-shaped article. The output control may also detect a form of the susceptor band, for example if the susceptor band has a deformed, for example bent, shape. These parameters have to be within a certain predefined threshold in order to be accepted. If the predefined thresholds are exceeded, the article is detected as not meeting the predefined quality specifications and the articles are rejected as waste.

Preferably, the output control comprises a rejection system, rejecting defective articles that comprise conditions of the susceptor band that do not meet the quality specifications.

If a waste ratio (defective articles versus accepted articles) exceeds a predefined waste threshold, detected information on the condition of the susceptor band by the output control is used to trigger the magnetic positioning unit for adjusting the at least one rotatable magnetic shaft. The output control may, for example comprise a camera arranged such as to provide an image of at least one end of the cut rod-shaped aerosol-generating article. The camera may detect the form and position of the susceptor band in the cut article. This may be compared with predefined parameters for the susceptor band in the cut article. If any one of the detected parameters is out of the preset quality specification, the defective articles are rejected as waste. Preferably, a waste threshold for this waste is set for triggering the adjustment of the at least one magnetic shaft in order to reduce the waste. Admitted waste for the entire cutting process may, for example, be 1 percent. If the waste increases and exceeds this 1 percent threshold, a magnetic shaft adjustment will be triggered in order to reduce the waste.

The magnetic positioning unit may comprise an actuator for rotating the at least one rotatable magnetic shaft. The magnetic positioning unit may comprise several actuators for rotating several rotatable magnetic shafts. Preferably, each of the several rotatable magnetic shafts comprises an actuator for individually rotating each one of the several rotatable magnetic shafts.

The magnetic shafts being rotatable make it possible to dynamically adjust a rotational position of the articles and accordingly a susceptor angle within the articles, so that an optimized cutting angle for the susceptor may be achieved by the gradual adjustment of the magnetic shafts. This is advantageous in many ways. For example, articles may be displaced during transport or a previous cutting step such that the initial position of the susceptor band in an uncut article when being fed into the conveyor may no longer correspond to the actual position of the susceptor band before being cut. Another example may be that the position of the plane of the susceptor band may not be identical over a length of an article. Thus, if the position of a susceptor band is measured at ends of an uncut article only, this may not correspond to the position of the susceptor band in a cut article, for example cut from the middle of the uncut article. Yet another example may be the ramping up of a cutting process where a conveyor is not yet at its final operational speed and the transport speed of the articles varies while being received by the conveyor and cut on the conveyor. During a cut, in general there is a small spinning effect on the rods applied by the circular knifes. As this rod spin is related to the time necessary for cutting the rod, during the ramp up of a machine it is thus preferable having an adjustable cutting angle in order to be able to compensate machine acceleration.

The apparatus may comprise a velocity sensor for measuring a moving speed of the conveyor. Preferably, the velocity sensor is coupled to a controller controlling the magnetic positioning unit.

According to the invention, there is also provided a method for aligning rod-shaped aerosol-generating articles comprising a susceptor band. The method comprises receiving an aerosol-generating article comprising a susceptor band in a seat of a conveyor, transporting and holding the aerosol-generating article in the seat of the conveyor and contactless rotating the aerosol-generating article around a longitudinal axis of the article to a defined position by a magnetic positioning unit comprising a rotatable magnetic shaft. The method further comprises cutting the aerosol-generating article in the defined position, thereby cutting the susceptor band at a cutting angle between 20 degree and 70 degrees, preferably between 30 degree and 60 degree, for example at 45 plus or minus 5 degree.

The method comprises temporarily releasing the aerosol-generating article allowing the aerosol-generating article to rotate to the defined position, then fixing the aerosol-generating article in the defined position.

Holding and rotating of an article may be performed simultaneously if the forces to rotate the article overcome a holding force. Preferably, a holding of the article is reduced or interrupted for rotating the article. For example, a suction force applied to an article may be temporarily reduced to allow rotation of the article. An applied suction force may also be temporarily interrupted to release the article. However, in some embodiments of the present invention, even the holding means itself may also be changed, for example, switching from a suction force applied to an article to a retaining surface or guiding element that is provided to prevent an article from falling out from its seat, preferably without interfering with the rotation of the article. When the article has been rotated around its longitudinal axis to its defined position, the article is preferably fixed in the defined position for a further processing step, for example by application of suction force to the article.

Preferably, the method comprises fixing the aerosol-generating article in the defined position and cutting the aerosol-generating article. The fixing allows to perform the cutting at the defined position. Thus, the article is kept in the defined position before and during the cutting. Depending on the further processing of the article, the article may also be kept in the defined position after cutting.

Preferably, the method comprises arranging the magnetic positioning unit comprising the rotatable magnetic shaft external to the conveyor.

The method typically comprises transporting the aerosol-generating article from a receiving location, where the article is received on the conveyor, to a positioning location, where the rotational positioning of the article is performed, and to a cutting location where the article is cut. wherein the positioning location is arranged downstream of the receiving location and the cutting location is arranged downstream of the positioning location.

The method may comprise at least a further cutting location arranged downstream of the cutting location. The article may be cut into several segments in a same and in several subsequent cutting steps as already described above.

If several subsequent cutting steps are provided, the method preferably comprises rotating the aerosol-generating article to the defined position upstream of each of the cutting locations and at least one further cutting location. A rotatable magnetic shaft may be provided upstream of each of the cutting location and the further cutting location. This is advantageous as any divergence of the rotational position of the susceptor band in the article from a defined position may be adjusted right before the article is cut or cut again.

Preferably, the method comprises providing a guiding element arranged parallel to the conveyor, the guiding element preventing the falling out of the aerosol-generating article from the conveyor, and mounting the magnetic positioning unit on the guiding element.

Preferably, the method comprises transporting the aerosol-generating article in a flute of a fluted conveyor drum. When using a fluted conveyor drum, the method preferably comprises continuously providing aerosol-generating articles to flutes of the fluted conveyor drum.

Preferably, the method further comprises individually rotating each of the aerosol-generating articles to the defined position. Several aerosol-generating articles may be rotated simultaneously.

The method may comprise adapting the rotation of the rotatable shafts depending on a transport speed of the aerosol-generating article.

Preferably, the method comprises holding the aerosol-generating article on the conveyor drum by suction force applied to the article.

The method may further comprise an output control detecting a condition of the susceptor band in a final cut aerosol-generating article and rejecting final cut aerosol-generating articles with defective susceptor bands as waste. If the waste exceeds a predefined waste threshold, the method comprises using information on a detected output condition of the susceptor band in the cut aerosol-generating article to rotate the rotatable magnetic shaft and thereby to adjust the rotating of the aerosol-generating article.

Thus, while any defective articles, thus any articles where the detected condition of the susceptor band does not meet predefined quality specifications, are preferably rejected as waste, adjustment of the magnetic positioning unit is preferably initialized only when a waste ratio exceeds a predefined waste threshold.

As used herein, the term 'susceptor' refers to a material that is capable to convert electromagnetic energy into heat. When located in an alternating electromagnetic field, typically eddy currents are induced and hysteresis losses may occur in the susceptor causing heating of the susceptor. As the susceptor is located in thermal contact with aerosol-forming substrate, the aerosol-forming substrate is heated by the susceptor, releasing aerosol-forming substances from the substrate.

The susceptor may be formed from any material that can be inductively heated to a temperature sufficient to release material from the aerosol-forming substrate. Preferred susceptors comprise a metal or carbon. A preferred susceptor may comprise or consist of a ferrous or ferromagnetic material, for example ferritic iron, a ferromagnetic alloy, such as ferromagnetic steel, stainless steel or aluminium. The susceptor preferably comprises more than 5 percent, preferably more than 20 percent, preferably more than 50 percent or 90 percent of ferromagnetic or paramagnetic materials. Preferred susceptors may be heated to a temperature between about 150 degree Celsius and about 300 degree Celsius. Preferably, the susceptors may be heated to a temperature between about 200 degree Celsius and about 270 degree Celsius, for example 235 degree Celsius.

Preferably, a susceptor sheet material as is a metallic band.

Preferably, a susceptor sheet material is a stainless steel band. However, susceptor materials may also comprise or be made of graphite, molybdenum, silicon carbide, aluminum, niobium, Inconel alloys (austenite nickel-chromium-based superalloys), metallized films, ceramics such as for example zirconia, transition metals such as for example Iron, Cobalt, Nickel, or metalloids components such as for example Bor, Carbon, Silicium, Phosphor, Aluminium.

Preferably, the susceptor band has a basic rectangular shape having a width preferably between about 2 millimeter and about 8 millimeter, more preferably, between about 3 millimeter and about 5 millimeter, for example 4 millimeter and a thickness preferably between about 0.03 millimeter and about 1 millimeter, more preferably between about 0.05 millimeter and about 0.5 millimeter, for example between about 0.07 millimeter and about 0.2 millimeter. The width of the susceptor band is smaller than a width or diameter of a rod-shaped aerosol-generating article the susceptor band is arranged in.

As a general rule, whenever the term 'about' is used in connection with a particular value throughout this application this is to be understood such that the value following the term 'about' does not have to be exactly the particular value due to technical considerations. However, the term 'about' used in connection with a particular value is always to be understood to include and also to explicitly disclose the particular value following the term 'about'. The aerosol-generating article has the form of a rod with a rod diameter, preferably in the range between about 3 millimeters to about 12 millimeters, more preferably between about 4 millimeters to about 8 millimeters, for example 7 millimeters. Preferably, the rod has a circular or oval cross-section. However, the rod may also have the cross-section of a rectangle or of a polygon.

The aerosol-generating article comprises an aerosol-forming substrate, capable of forming an aerosol. The aerosol-forming substrate is a solid and may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

The aerosol-forming substrate may comprise one or more sheets of homogenised tobacco material that has been gathered into a rod, provided with the susceptor band and circumscribed by a wrapper. Preferably, the aerosol-forming substrate comprises a crimped and gathered sheet of homogenised tobacco material.

A tobacco sheet forming the aerosol-forming substrate may comprise tobacco particles, fiber particles, aerosol former, binder and for example also flavours.

Preferably, the aerosol-forming tobacco substrate is a tobacco sheet, preferably crimped, comprising tobacco material, fibers, binder and aerosol former. Preferably, the tobacco sheet is a cast leaf. Cast leaf is a form of reconstituted tobacco that is formed from a slurry including tobacco particles, fiber particles, aerosol former, for example glycerol or propylene glycol, binder and for example also flavours.

The invention is defined in the claims. However, below there is provided a non-exhaustive list of non-limiting examples. Any one or more of the features of these examples may be combined with any one or more features of another example, embodiment, or aspect described herein.

Example Ex1: Apparatus for aligning rod-shaped aerosol-generating articles comprising a susceptor band, the apparatus comprising:

- a conveyor for accommodating and transporting an aerosol-generating article comprising a susceptor band;
- a holding means for holding the aerosol-generating article in the conveyor, the holding means adapted to allow temporary rotation of the aerosol-generating article;
- a magnetic positioning unit for rotating the aerosol-generating article held by the holding means around a longitudinal axis of the article to a defined position;
- a cutting device for cutting the aerosol-generating article in the defined position, wherein the magnetic positioning unit comprises at least one rotatable magnetic shaft.

Example Ex2: Apparatus according to Example Ex1, wherein the at least one rotatable magnetic shaft is diametrically magnetized.

Example Ex3: Apparatus according to any one of the preceding Examples, wherein the at least one rotatable magnetic shaft has the form of a rod comprising at least one slit running circumferentially around a longitudinal rotation axis of the at least one rotatable magnetic shaft for parts of the cutting device to pass through the at least one slit to cut the aerosol-generating article.

Example Ex4: Apparatus according to any one of the preceding Examples, wherein a longitudinal rotation axis of the at least one rotatable magnetic shaft is arranged parallel to a longitudinal axis of a seat in the conveyor.

Example Ex5: Apparatus according to any one of the preceding Examples, comprising a guiding element arranged at a distance and parallel to the conveyor for preventing aerosol-generating articles from falling off the conveyor.

Example Ex6: Apparatus according to any one of the preceding Examples Ex5 or Ex6, wherein the magnetic positioning unit is arranged external to the conveyor.

Example Ex7: Apparatus according to Examples Ex5 or Ex6, wherein the magnetic positioning unit is mounted on the guiding element.

Example Ex8: Apparatus according to any one of Examples Ex5 to Ex7, wherein the cutting device is mounted on the guiding element.

Example Ex9: Apparatus according to any one of the preceding Examples, wherein the cutting device comprises at least one circular cutting knife.

Example Ex10: Apparatus according to Example Ex9, wherein the cutting device comprises a series of circular cutting knives arranged in parallel to each other.

Example Ex11: Apparatus according to Examples Ex9 or Ex10, wherein the cutting device comprises a series of circular cutting knives arranged in sequence to each other.

Example Ex12: Apparatus according to Example Ex11, comprising several rotatable magnetic shafts arranged in sequence to each other, wherein a rotatable magnetic shaft is arranged upstream of a circular cutting knife.

Example Ex13: Apparatus according to Example Ex12, wherein each rotatable magnetic shaft of the several rotatable magnetic shafts is assigned to a different circular cutting knife of the series of circular cutting knives.

Example Ex14: Apparatus according to any one of Examples Ex12 to Ex13, wherein all of the several rotatable magnetic shafts are diametrically magnetized.

Example Ex15: Apparatus according to Example Ex14, wherein the several rotatable magnetic shafts have the form of a rod comprising circumferential slits, the slits running circumferentially around the longitudinal axes of the several rotatable magnetic shafts.

Example Ex16: Apparatus according to any one of the preceding Examples, wherein the magnetic positioning unit comprises a permanent magnet.

Example Ex17: Apparatus according to any one of the preceding Examples, wherein the magnetic positioning unit comprises an electromagnet.

Example Ex18: Apparatus according to any one the preceding Examples, wherein the conveyor comprises several seats, each seat for accommodating an aerosol-generating article in the seat.

Example Ex19: Apparatus according to any one of the preceding Examples, wherein the conveyor is a fluted conveyor drum comprising several flutes, each flute for accommodating an aerosol-generating article.

Example Ex20: Apparatus according to Examples Ex19, wherein a rotation axis of the at least one rotatable magnetic shaft is arranged parallel to the flutes of the fluted conveyor drum.

Example Ex21: Apparatus according to any one the preceding Examples, wherein the holding means comprises suction means applicable to a seat in the conveyor.

Example Ex22: Apparatus according to any one of the preceding Examples, comprising an output control for detecting a condition of the susceptor band in a cut aerosol-generating article, for comparing the detected condition with quality specifications, for rejecting cut aerosol-generating article as waste when not meeting the quality specifications, and for triggering the magnetic positioning unit for adjusting the at least one rotatable magnetic shaft, if the rejected cut aerosol-generating article exceed a predefined waste threshold.

Example Ex23: Apparatus according to Example Ex22, wherein the output control comprises a camera arranged such as to provide an image of at least one end of the cut rod-shaped aerosol-generating article.

Example Ex24: Apparatus according to any one of the preceding Examples, wherein the magnetic positioning unit comprises an actuator for rotating the at least one rotatable magnetic shaft.

Example Ex25: Apparatus according to Example Ex12, wherein each of the several rotatable magnetic shafts comprises an actuator for individually rotating each one of the several rotatable shafts.

Example Ex26: Method for aligning rod-shaped aerosol-generating articles comprising a susceptor band, the method comprising:

receiving an aerosol-generating article comprising a susceptor band in a seat of a conveyor;

transporting and holding the aerosol-generating article in the seat of the conveyor; contactless rotating the aerosol-generating article around a longitudinal axis of the article to a defined position by a magnetic positioning unit comprising a rotatable magnetic shaft and cutting the aerosol-generating article in the defined position, thereby cutting the susceptor band at a cutting angle between 20 degree and 70 degrees.

Example Ex27: Method according to Example Ex26, therein temporarily releasing the aerosol-generating article allowing the aerosol-generating article to rotate to the defined position, then fixing the aerosol-generating article in the defined position.

Example Ex28: Method according to any one of Examples Ex26 to Ex27, wherein the cutting angle is between 30 degree and 60 degree, for example 45 plus or minus 5 degree.

Example Ex29: Method according to any one of Example Ex26 to Ex28, therein arranging the magnetic positioning unit external to the conveyor.

Example Ex30: Method according to any one of Examples Ex26 to Ex29, therein transporting the aerosol-generating article from a receiving location to a positioning location and to a cutting location, wherein the positioning location is arranged between the upstream receiving location and the downstream cutting location.

Example Ex31: Method according to Example Ex30, comprising at least one further cutting location arranged downstream of the cutting location.

Example Ex32: Method according to Example Ex31, therein rotating the aerosol-generating article to the defined position upstream of each the cutting location and the at least one further cutting location.

Example Ex33: Method according to Example Ex32, therein providing a rotatable magnetic shaft upstream of each the cutting location and the at least one further cutting location.

Example Ex34: Method according to any one of Example Ex26 to Ex33, therein providing a guiding element arranged parallel to the conveyor preventing falling out of the aerosol-generating article from the conveyor and mounting the magnetic positioning unit on the guiding element.

Example Ex35: Method according to any one of Example Ex26 to Ex34, therein transporting the aerosol-generating article in a flute of a fluted conveyor drum.

Example Ex36: Method according to Example Ex35, continuously providing aerosol-generating articles to flutes of the fluted conveyor drum and individually rotating each of the aerosol-generating articles to the defined position.

Example Ex37: Method according to Example Ex36, wherein several aerosol-generating articles are rotated simultaneously.

Example Ex38: Method according to any one of Examples Ex26 to Ex37, therein adapting the rotation of the rotatable shafts depending on a transport speed of the aerosol-generating article.

Example Ex39: Method according to any one of Examples Ex26 to Ex38, therein holding the aerosol-generating article by suction force applied to the article.

Example Ex40: Method according to any one of Examples Ex26 to Ex39, further comprising an output control detecting a condition of the susceptor band in a final cut aerosol-generating article; rejecting final cut aerosol-generating articles with defective susceptor bands as waste; and if the waste exceeds a predefined waste threshold, using information on a detected output condition of the susceptor band in the cut aerosol-generating article to rotate the rotatable magnetic shaft and thereby to adjust the rotating of the aerosol-generating.

Examples will now be further described with reference to the figures in which:

FIG. 1 shows a perspective cut-open view of an aerosol-generating article comprising a susceptor band;

FIG. 2 schematically shows a cutting process of rod-shaped articles on a fluted conveyor drum;

Figure 1:
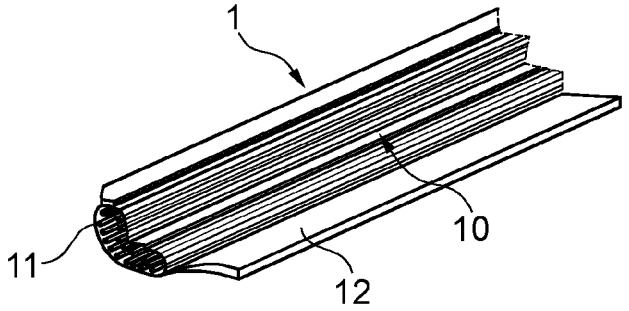

FIG. 1 shows a cut-open view of a rod-shaped aerosol-generating article 1 comprising a susceptor band 10. A continuous planar susceptor band 10 is arranged along the center of a continuous aerosol-forming substrate 11. The substrate 11 may be a gathered sheet of homogenized tobacco material. The article 1 is wrapped with a wrapping material 12, for example a paper wrapper. The article 1 is cut from a continuous rod and typically has a length which is a multiple of the length of a final plug that is subsequently combined with other segments to create the final consumable. The final consumable may be used in electronic inductive heating devices for aerosol generation by inductively heating the susceptor band 10 and by this the aerosol-forming substrate 11 in the vicinity of the susceptor band 10.

Usually, initial rods have a length of 120 mm and are cut into 10 plugs by several cutting steps, each plug then having a length of 12 mm.

Figure 2:
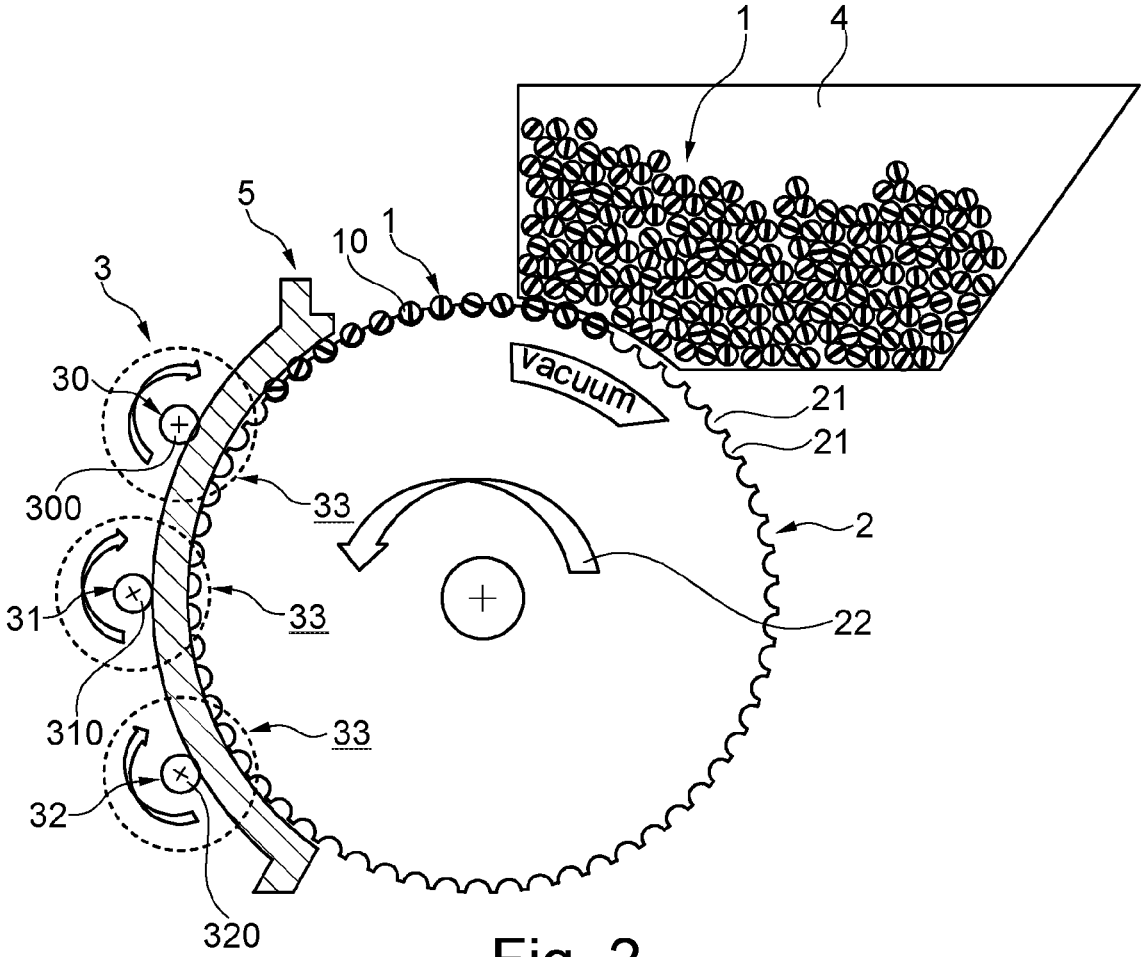

As shown in more detail in FIG. 2, cutting the aerosol-generating article 1 is performed in three cutting steps using three different cutting knife arrangements. In a first cutting arrangement 30, two cuts are applied to the article, in a second cutting arrangement 31 three cuts are applied and in a third and last cutting arrangement 32 four cuts are applied to the article 1.

Aerosol-generating articles 1 comprising a susceptor band 10 are provided in a hopper 4, which is arranged above a conveyor drum 2. The articles are then fed into flutes 21 of the fluted conveyor drum 2 in a receiving location using gravity and suction force.

The articles 1 are held in the flutes 21 by suction force applied to the flutes from the conveyor drum 2.

The articles 1 are transported by rotation of the conveyor drum 2 (indicated by arrow 22) to subsequent first, second and third cutting locations, where the articles are cut transversally by rotating circular knives 33.

The cutting device 3 comprises three cutting arrangements 30,31,32. Each cutting arrangement comprises at least one, but preferably two or more circular knives 33 which are arranged in parallel on a common rotatable cutting shaft 300,310,320. The three cutting arrangements 30,31,32 are arranged subsequently and preferably equidistantly along the circumference and moving direction of the conveyor drum 2.

The cutting device 3 is integrated into a guiding element 5. The guiding element 5 is a curved plate arranged parallel to the circumference of the conveyor drum 2. The guiding element 5 prevents the articles 1, which are cut either before or afterwards, from falling out of the flutes 21. The guiding element 5 comprises slits for the cutting knives 33 to pass through the slits for cutting the articles 1 in the flutes 21.

Suction force may be provided under the hopper 4 only. Suction force may also be provided from the hopper 4 to the guiding element 5.

As may be seen in FIG. 2, the articles 1 are fed with random rotational orientation to the drum 2. By this, also the orientation of the susceptor bands in the articles 1 is random. This random susceptor orientation generates high rejects on the machine, for example more than 15 percent, due to an improper cut of the susceptor band (displaced, bent or deformed susceptor band). In addition, good orientation of the susceptor band and cut angle helps to increase the lifetime of the circular knives.

Figure 3:
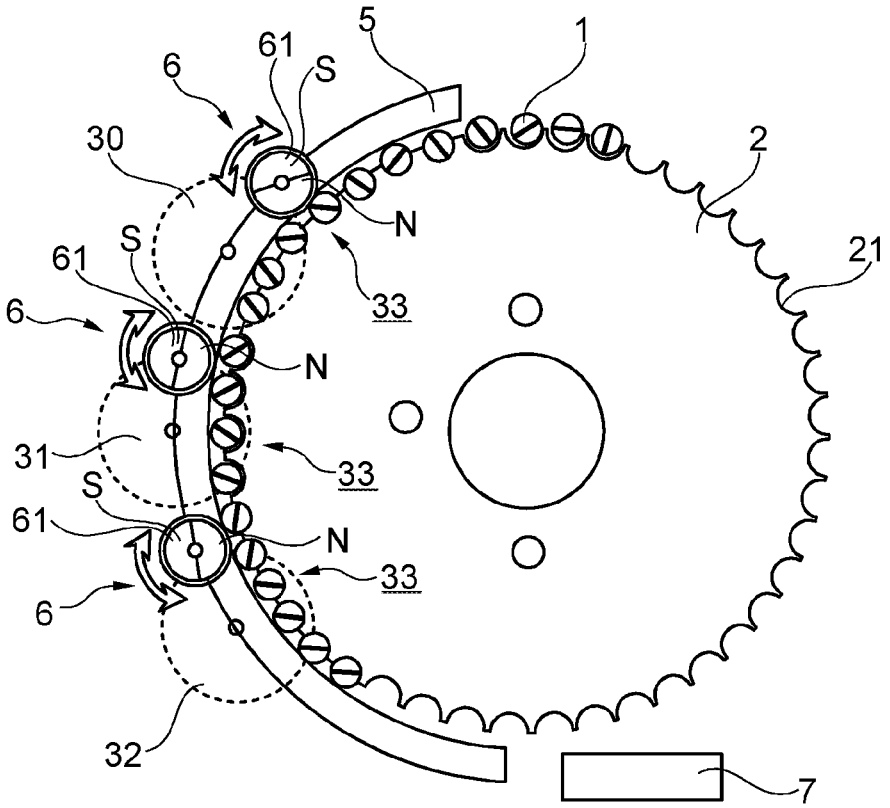
FIG. 3 shows the cutting process with magnetic positioning unit.

In FIG. 3 the set-up of FIG. 2 is shown including three magnetic positioning units 6 each comprising a magnetic shaft 61. The magnetic shafts 61 extend over the width of the conveyor drum 2 and are arranged parallel to the flutes 21 in the conveyor drum. The magnetic shafts 61 are arranged parallel to the longitudinal axis of the articles 1 in the flutes 21 and accordingly essentially parallel to the susceptor band 10 in the articles 1. The magnetic force of the magnetic shafts 61 acting on the susceptor bands may force the articles to rotate as physically the susceptor tends to be aligned with the magnetic field lines.

An optimal orientation of susceptor band 10 relative to the position of the cutting knife 33 is set as a defined position. The magnetic shaft 61 is rotated around its longitudinal rotation axis until a position where the magnetic force of the magnetic shaft 61 may rotate the article to the defined position before being cut. Appropriate actuators to rotate the magnetic shafts 61 are present but not shown in the drawings. Preferably, one actuator per magnetic shaft 61 is provided to rotate the magnetic shafts individually and separately.

The magnetic shafts 61 are diametrically magnetized permanent magnets that are longitudinally divided in two magnetic poles.

The magnetic shafts 61 are each arranged immediately upstream of a cutting arrangement 30,31,32. By this, an article 1 may be rotated to the defined position irrespective of an inadvertent displacement due to the transport or a previous cutting of the article. In the embodiment of FIG. 3, rotating each magnetic shaft by a gradual adjustment is possible to align the susceptor band before a cut in order to reach the optimal orientation.

The positioning unit 6 is integrated into the guiding element 5. In particular, the magnetic shafts 61 are mounted on the guiding element 5.

The apparatus is provided with an output control 7 arranged downstream of the last cutting arrangement 32. The output control detects a defective cut of the susceptor band or in general a misplacement or deformation of the susceptor band in the article. The output control 7 comprises, for example, a camera or other, preferably optical, device to detect the position and form of the susceptor band in the final cut article. The output control may, for example, provide an image of at least one end of the cut rod-shaped aerosol-generating article 1, of both ends of the article or of the whole susceptor band within the cut article.

The susceptor band should be straight and arranged in a center of the cross section of the article. If a susceptor band has been deformed during a cut or if a susceptor band is displaced, the amount of deformation and displacement is detected by comparison of the detected values of the output control and predefined quality specifications. For each of the detected parameters, for example, form, rotational position, sideway displacement of the susceptor band etc., predefined thresholds must not be exceeded. For example, a susceptor band should not be closer to a circumference of an article than 1 millimeter. If the susceptor band is displaced such as to be closer to the circumference of the article than 1 millimeter, the article is considered defective and rejected as waste. Thus, the information on the condition of the susceptor band in the final cut article is used to accept articles or reject defective articles, thus article comprising a defective susceptor band. The apparatus may comprise an according rejection system (not shown).

The output control is in communication with the magnetic positioning unit 6, in particular with one or all of the magnetic shafts 61 of the positioning unit 6. If the amount of rejected defective articles, thus the waste exceeds a certain predefined waste threshold, the information detected by the output control 7 is then used to rotate the rotatable magnetic shaft 61 and thereby to adjust the rotating of the aerosol-generating article.

By the output control, the final result of the entire cutting process may be controlled and used for adjusting the magnetic positioning unit. This may result in even further improved cut articles and reduced waste. The output control 7 may uniquely or additionally be used as final control unit giving information to a discharge unit (not shown) to discharge damaged or defective cut articles 1.

Figure 4:
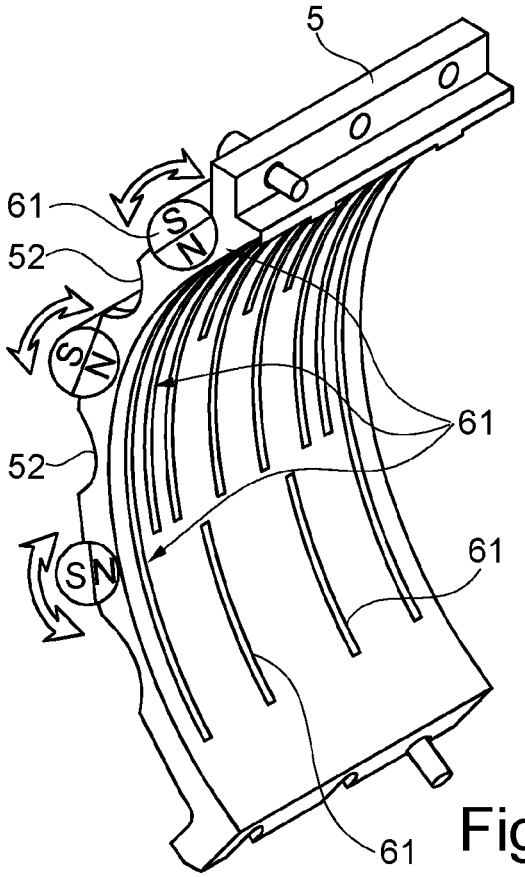
FIG. 4 shows a perspective view of a guiding element with integrated magnetic shafts.

In FIG. 4 the guiding element 5 is shown separately. An inner side of the guiding element is even with a curved form corresponding to the circumference of the conveyor drum 2. The guiding element 5 is provided with circumferential slits 61 for the cutting knives 33 of the cutting device 3 to pass through the slits 61. The outer side of the guiding element 5 is provided with grooves 52. The grooves 52 are arranged parallel to the flutes 21 in the conveyor drum. The magnetic shafts 61 as well as the cutting arrangements 30,31,32 (not shown in FIG. 4) are accommodated in the grooves, so that the magnetic shafts 61 are arranged parallel to the articles in the flutes. The provision of the grooves 52 on the guiding element 5 to accommodate the magnetic shafts 61 allows the magnetic shafts 61 to be positioned very close to the articles to optimize the magnetic effect of the magnetic shafts on the articles. This arrangement allows a very compact set-up of the apparatus of the present invention.

The material of the guiding element 5 as well as the materials of the further elements of the apparatus, such as, for example, the conveyor drum, the cutting device etc. are preferably made of non-magnetic and non-magnetizable materials in order not to interfere with the magnetic positioning unit.

Figure 5:
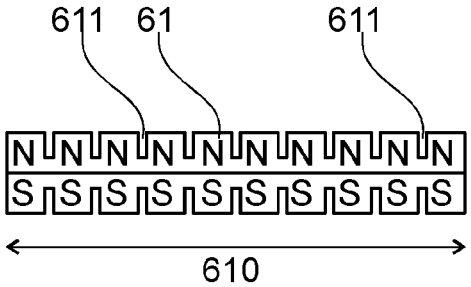
FIG. 5 shows a schematic cross section of a magnetic shaft.

FIG. 5 shows a longitudinal cross section of an exemplary magnetic shaft 61 having a rod shape with a diameter of 20 mm. The length 610 of the magnetic shaft 61 is about 118 mm. The magnetic shaft in the form of a permanent magnet is diametrically magnetized with one magnetic pole on the upper half of the magnetic shaft 61 and the other magnetic pole on the lower half of the shaft 61 in FIG. 5. The magnetic shaft is provided with several, here nine, slits 611 running circumferentially around the longitudinal rotation axis of the magnetic shaft 61.

The slits 611 have a width of 2 mm allowing the cutting knives 33 to enter the magnetic shaft 61 allowing for a compact construction of magnetic positioning unit 6 and cutting device 3. In addition, a cut may be performed immediately after the article 1 has been positioned, leaving no time for an inadvertent displacement of the article.

Figure 6:
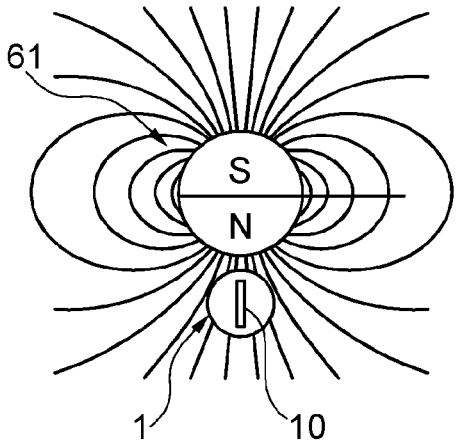
FIGS. 6 and 7 show different relative orientations of magnetic shaft and aerosol-generating article.
Figure 7:
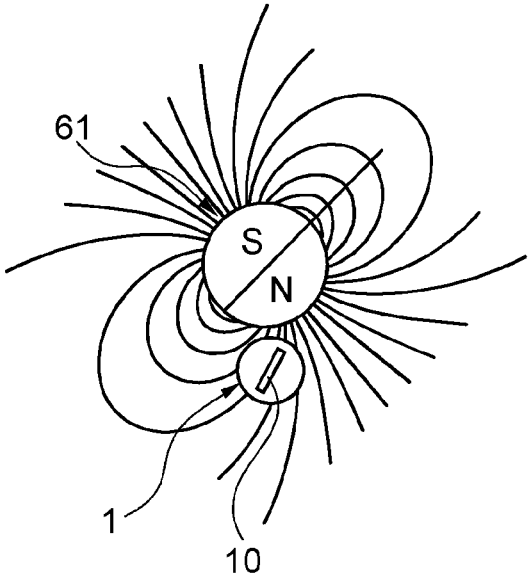

FIG. 6 and FIG. 7 are illustrations showing two magnetic shafts 61 rotated so that they generate different magnetic orientations relative to an article 1 comprising a susceptor band. A rotation of the magnetic shafts 61 may not only be used to cause rotation of an article to a defined position in a fixed machine set-up. It may also be used, for example, to dynamically adjust the susceptor angle according to specific variable process parameters, like for instance the speed of the drum, which may vary during the ramp up of the machine. In such embodiments, the differing apparatus parameters are also taken into account when rotating the magnetic shafts.

Figure 8:
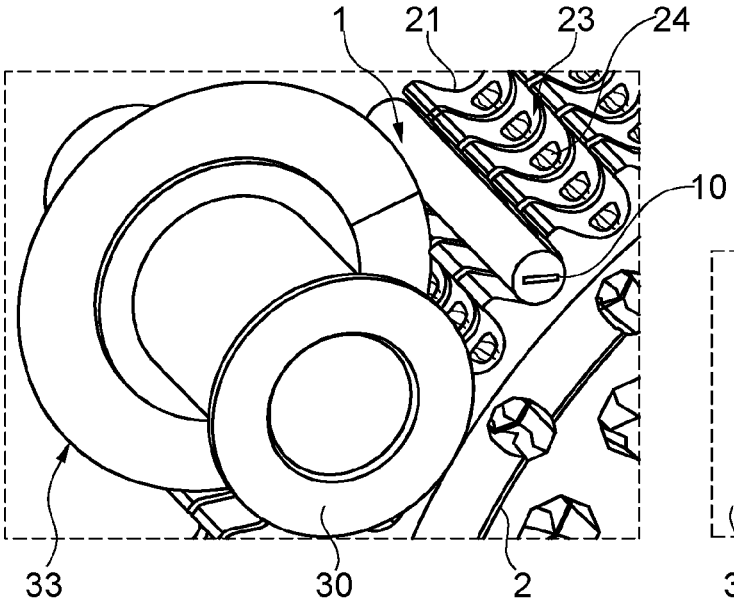
FIG. 8 shows a detailed view of an aerosol-generating article in the cutting position.

FIG. 8 shows a detailed view of the article 1 just before being cut. In FIG. 8, the guiding element 5 is omitted. The article 1 is arranged in a flute 21 of the conveyor drum 2. The conveyor drum is assembled from several individual parallel arranged disks 23 forming the flutes 21 at their circumference. The disks 23 are provided with slits in between the disks 23 for a cutting knife 33 to enter in between the disks 23 when cutting the article 1. The flutes 21 are provided with throughholes 24 communicating with the interior of the conveyor drum 2 and a suction device arranged inside the conveyor drum. Before being cut, the article 1 is rotated by the magnetic positioning unit to a previously defined optimal position, which is in general defined by the relative position between susceptor band 10 and cutting knife 33.

As discussed in the preamble, to ensure the efficiency and consistency of the performance of the consumable, the susceptor band 10 should not be moved, deformed, damaged or bent during the cut. Such unwanted modifications of the shape of the susceptor band and position inside a plug alters the heating of the final consumable and may create inefficiency and waste of aerosol-forming substrate as well as inconsistency of the consumables.

It appears that the orientation of the susceptor band inside the aerosol-forming substrate rods before the cut performed by the circular knife 33 has a huge impact on the quality of the cut.

Figure 9:
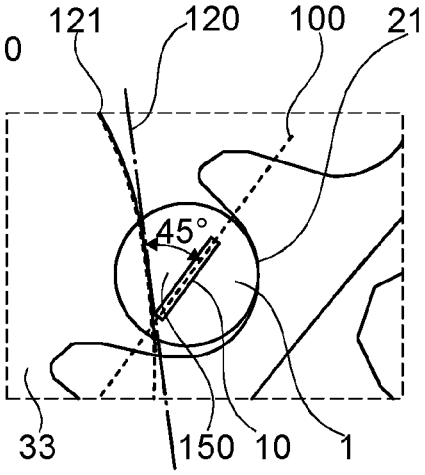
FIG. 9 shows an aerosol-generating article being cut.

It has been found that the best orientation of the susceptor band in order to have an efficient cut is approximately a cutting angle 150 of 45 degree±5 degree. Such an optimal position is shown in more detail in FIG. 9.

The orientation of the susceptor band 10 in the article is calculated for the location where and moment when the circular knife 33 starts to cut the susceptor band 10. The cutting angle 150 of 45 degree relative to the cutting knife 33 is calculated considering the angle between a straight line 100 passing through the plane of the susceptor band 10 and the tangent 120 of the circumference 121 of the circular knife 33.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±2% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An apparatus for aligning rod-shaped aerosol-generating articles comprising a susceptor band, the apparatus comprising:

a conveyor configured to accommodate and transport an aerosol-generating article comprising a susceptor band;

a holding means for holding the aerosol-generating article in the conveyor, the holding means being configured to allow temporary rotation of the aerosol-generating article;

a magnetic positioning unit configured to rotate the aerosol-generating article held by the holding means around a longitudinal axis of the aerosol-generating article to a defined position; and a cutting device configured to cut the aerosol-generating article in the defined position, wherein the magnetic positioning unit comprises at least one rotatable magnetic shaft.

2. The apparatus according to claim 1, wherein the at least one rotatable magnetic shaft is diametrically magnetized.

3. The apparatus according to claim 1, wherein the at least one rotatable magnetic shaft has a form of a rod comprising at least one slit running circumferentially around a longitudinal rotation axis of the at least one rotatable magnetic shaft for parts of the cutting device to pass through the at least one slit to cut the aerosol-generating article.

4. The apparatus according to claim 1, wherein a longitudinal rotation axis of the at least one rotatable magnetic shaft is arranged parallel to a longitudinal axis of a seat in the conveyor.

5. The apparatus according to claim 1, further comprising a guiding element arranged at a distance and parallel to the conveyor and being configured to prevent aerosol-generating articles from falling off the conveyor.

6. The apparatus according to claim 5, wherein the magnetic positioning unit is mounted on the guiding element.

7. The apparatus according to claim 5, wherein the cutting device is mounted on the guiding element.

8. The apparatus according to claim 1, wherein the cutting device comprises at least one circular cutting knife.

9. The apparatus according to claim 8, further comprising several rotatable magnetic shafts arranged in sequence to each other, wherein a rotatable magnetic shaft is arranged upstream of a circular cutting knife.

10. The apparatus according to claim 1, wherein the magnetic positioning unit further comprises a permanent magnet.

11. The apparatus according to claim 1, wherein the conveyor is a fluted conveyor drum comprising several flutes, each flute configured to accommodate an aerosol-generating article.

12. The apparatus according to claim 11, wherein a longitudinal rotation axis of the at least one rotatable magnetic shaft is arranged parallel to the flutes of the fluted conveyor drum.

13. The apparatus according to claim 1, further comprising an output control configured to detect a condition of the susceptor band in a cut aerosol-generating article, to compare the detected condition with quality specifications, to reject the cut aerosol-generating article as waste when not meeting the quality specifications, and to trigger the magnetic positioning unit to adjust the at least one rotatable magnetic shaft, if the rejected cut aerosol-generating article exceed a predefined waste threshold.

14. A method for aligning rod-shaped aerosol-generating articles comprising a susceptor band, the method comprising:

receiving an aerosol-generating article comprising a susceptor band in a seat of a conveyor, transporting and holding the aerosol-generating article in the seat of the conveyor;

contactless rotating the aerosol-generating article around a longitudinal axis of the aerosol-generating article to a defined position by a magnetic positioning unit comprising a rotatable magnetic shaft; and cutting the aerosol-generating article in the defined position, thereby cutting the susceptor band at a cutting angle between 20 degrees and 70 degrees.

15. The method according to claim 14, further comprising:

detecting, by an output control, a condition of the susceptor band in a final cut aerosol-generating article;

rejecting final cut aerosol-generating articles with defective susceptor bands as waste; and if the waste exceeds a predefined waste threshold, using information on a detected output condition of the susceptor band in the final cut aerosol-generating article to rotate a rotatable magnetic shaft and thereby to adjust the rotating of the final cut aerosol-generating articles.

* * * * *